United States Patent [19]

Price et al.

[11] 4,345,393

[45] Aug. 24, 1982

[54] PEELABLE ON-PACKAGE COUPON AND METHOD FOR MAKING SAME

[75] Inventors: Charles E. Price, Delton; George C. Ray, III, Battle Creek; Harold R. Grieve, Battle Creek; Robert G. Tomich, Battle Creek, all of Mich.

[73] Assignee: General Foods Corporation, White Plains, N.Y.

[21] Appl. No.: 134,736

[22] Filed: Mar. 28, 1980

Related U.S. Application Data

[63] Continuation of Ser. No. 836,873, Sep. 26, 1977, abandoned.

[51] Int. Cl.[3] ..... G09F 3/00

[52] U.S. Cl. ..... 40/312; 40/2 R

[58] Field of Search ..... 40/312, 306, 2 R

[56] References Cited

U.S. PATENT DOCUMENTS 1,004,055 9/1911 Martin et al. ..... 40/2 R 3,110,121 11/1963 Corrinet ..... 40/312

3,958,744 5/1976 Herglotz ..... 40/312 X

*Primary Examiner*—Gene Mancene

*Assistant Examiner*—Wenceslao J. Contreras

*Attorney, Agent, or Firm*—Thomas V. Sullivan; Daniel J. Donovan; Bruno P. Struzzi

[57] ABSTRACT

A laminated container structure in which a peelable coupon or the like forms an integral portion of the outer ply of the container wall and is defined by a perforated tear outline. In one embodiment, a release agent is coated on the back of the coupon area to prevent adherence of the coupon to the adhesive joining together the outer and inner plies of the container. In another embodiment, the inner ply is formed of cylinderboard adhesively fastened to the outer ply, the perforate coupon tear outline extending through the outer ply, adhesive and outermost layer of the inner ply so that peeling of the coupon will not remove the inner layers of the inner ply and thus not destroy the integrity of the container.

6 Claims, 7 Drawing Figures

PEELABLE ON-PACKAGE COUPON AND METHOD FOR MAKING SAME

This is a continuation, of application Ser. No. 836,873, filed Sept. 26, 1977 now abandoned.

BACKGROUND OF THE INVENTION

The present invention relates to a laminated or layered container structure and, more particularly, to a container or package having a readily detachable coupon incorporated in the outer ply or lamina thereof.

It is currently widespread practice in the merchandising of commodities which are packaged in closed containers, that a redeemable coupon, mailing piece, ticket or the like be packaged in the container. This has the effect that the purchaser cannot redeem the coupon until the package is opened to provide access to the commodity and coupon contained therein. Alternatively, the coupon may be affixed to the exterior surface of the container adapted for easy detachment thereof by a purchaser or consumer. However, this frequently entails the inadvertent loss of the coupon during storage, shipping or handling of the container, or may even be conducive to the theft of the coupon preceding the sale of the container. The coupon may also be printed on the exterior surface of the container or package, and may be cut out by the consumer after the container is opened. This, however, will destroy the integrity of the carton and prevent the merchandise contained therein from being stored for any appreciable length of time. Consequently, redemption of such a printed-on coupon is only practicable after the merchandise has been used and the container is in an emptied condition. Moreover, removal of this type of coupon necessitates the employment of a sharp cutting object, such as a scissors or knife.

DISCUSSION OF THE PRIOR ART

More recently, containers or packages have been developed which incorporate easily detachable or peelable portions as integral elements of the outer ply of the container structure.

Thus, Loderhose U.S. Pat. No. 24,962 discloses a phonograph record jacket having a detachable or peelable picture-bearing section incorporated in the outer ply of the jacket for separation thereof along a predetermined perforated tear outline. In this construction the removal of the section, or pictorial portion, will leave a loose and readily tearable peripheral edge in one exterior surface of the jacket, thereby rendering the latter easily torn and unsightly when repeatedly handled for any significant period of time.

Krug U.S. Pat. No. 2,420,045 relates to a coupon which is an element in the label of a container, adapted to be readily separated along perforated tear lines. However, in this instance, the coupon is an appendage of the label, which is then folded over to provide a double-thickness portion suitable for peeling off by the ultimate purchaser or consumer of the container. This structure requires the utilization of extra lengths of label material, while concurrently permitting the coupon to be inadvertently or deliberately detached from the container prior to the sale of the latter.

Corrinet U.S. Pat. No. 3,110,121 and Gorman et al. U.S. Pat. No. 3,463,303 also describe containers providing for detachable elements as integral components of a label applied to a container wall structure. However, neither of these patents contemplate the element being an integral portion entirely contained within the outer ply of a laminate forming the wall structure of the container.

SUMMARY OF THE INVENTION

In order to obviate or ameliorate the shortcomings and limitations encountered in the prior art containers incorporating removable surface portions, the present invention contemplates a laminated or multiple-ply container structure comprising an inner ply of a semi-rigid material, such as paperboard, and an outer ply of a generally pliant material, such as glossy finished paper, adhesively joined thereto by means of a suitable laminant. Formed in the outer ply of the container, as an integral component thereof, and through the intermediary of a tear outline constituted of perforations extending through said outer ply is a readily removable or peelable coupon, the peeling off of the coupon being adapted to be accomplished without adversely affecting the integrity of the container structure or necessitating the use of special tools.

In one form of the invention, the interior surface of the outer ply, in effect, the surface in contact with the adhesive material bonding the outer ply to the inner ply of the laminated material is provided with a coating of a release agent or adhesive-repellent medium over an area which is coextensive with the area defined by the coupon, in effect, within the region bounded by the perforate tear outline. The provision of this coating on the back portion of the outer ply forming the coupon will facilitate the easy peeling off of the coupon by the purchaser of the package or container, and permit the coupon to be immediately redeemed at the location of purchase while the integrity of the container is concurrently fully maintained.

In another embodiment of the invention, wherein the inner wall of the laminated container is constituted of cylinder-board, namely of a multiple-ply or layered construction, the necessity for providing a release agent coating or adhesive-repellent medium between the surface of the coupon portion of the outer ply and the adhesive is obviated, since peeling off of the coupon from the container will result in the concurrent removal therewith of the adhesive layer therebeneath and the outermost layer or top liner of the inner ply adhering to the adhesive material, without adverse effects on the integrity of the package or container structure.

Accordingly, it is a primary object of the present invention to provide a laminated container structure of the type described hereinabove which will permit the incorporation of a readily removable or peelable coupon as an integral component of the outer ply of the multi-plied container structure.

Another object of the present invention is to provide a novel laminated container structure in which the removal of the coupon integrally formed in the outer ply of the container will not adversely affect the integrity of the container structure, and will allow for the coupon to be redeemed at the time of purchase of the container.

Yet another object of the present invention is to provide a laminated carton structure of the type described in which the portion of the outer ply constituting the coupon has the surface thereof facing the adhesive material coated with a release agent or adhesive-repellent medium to thereby permit the easy peeling off of the coupon without the necessity of employing any specialized tools or sharp cutting implements.

A further object of the present invention is to provide a laminated container structure of the type described, wherein the coupon which is incorporated in the outer ply of the container as an integral portion thereof may be readily detached or peeled therefrom together with the adhesive material and the outer layer of the inner ply without destroying or adversely affecting the integrity of the container, and in which the inner ply is formed of a multi-layered cylinderboard to thereby obviate the necessity of employing a release agent or adhesive-repellent coating beneath the coupon portion of the outer ply.

A still further object of the invention is to provide an improved method for making a carton incorporating a peelable coupon in the outer surface thereof.

BRIEF DESCRIPTION OF THE DRAWINGS

These and other objects of the present invention may be more readily understood by having reference to the following detailed description of preferred embodiments of the inventive laminated container structure incorporating the peelable coupon, taken in conjunction with the accompanying drawings, in which.

DETAILED DESCRIPTION OF THE INVENTION

Figure 1:
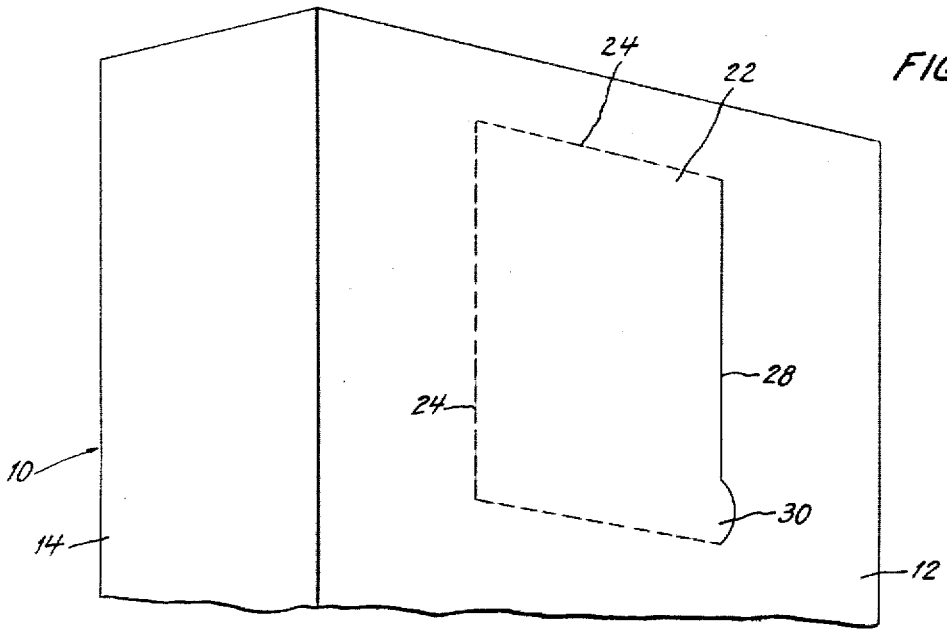
FIG. 1 shows a perspective view of a portion of a laminated container structure in conformance with the present invention.
Figure 2:
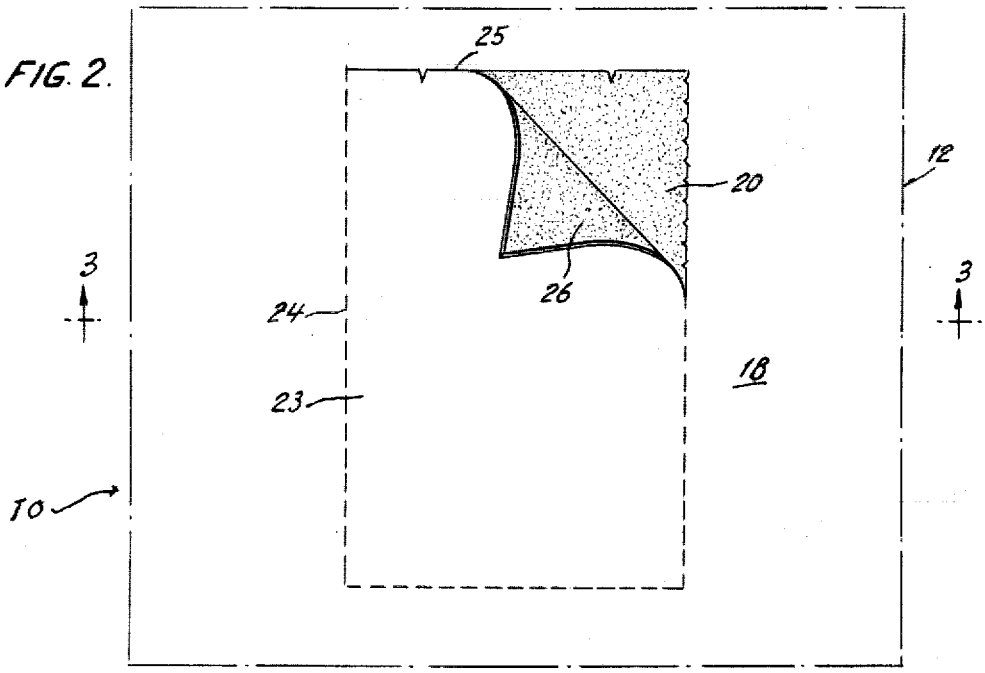
FIG. 2 is an elevational view of a portion of a container similar to that of FIG. 1 and illustrating a somewhat modified coupon design.
Figure 3:
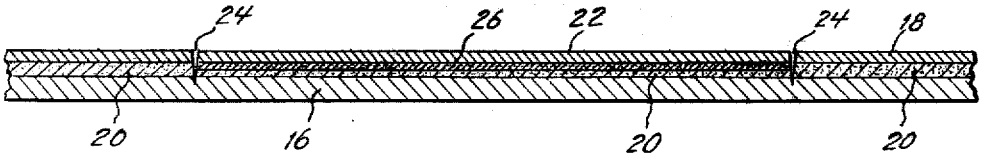
FIG. 3 is a sectional view, on an enlarged scale, taken along line 3—3 in FIG. 2.

Referring now in detail to the drawings, the embodiments illustrated in FIGS. 1 to 3 are directed to a merchandise package or container structure 10 which is basically constituted of a rectangularly-sided carton for bulk goods or products such as, for example, cereal, cookies, condiments or other consumer oriented merchandise. The portions of container 10 shown in FIG. 1 includes the usual front and side panels 12 and 14. In the FIG. 2 embodiment, only a portion of the front panel 12 is shown.

As is well known in the art, the carton 10 may be constituted of a laminated or multi-ply construction comprising an inner ply 16 formed of a relatively rigid paperboard or cardboard material and an outer ply 18 formed of a more pliant material, such as a glossy finished paper, adapted to have suitable indicia or art work imprinted thereon. The outer ply 18 is adhesively joined to the inner ply 16 through the interposition of a layer or coating of an adhesive material or glue 20.

A peelable or detachable coupon 22 or 23 may be incorporated in the outer ply 18, as an integral portion of the latter, on one of the panels 12 or 14 of the carton 10 by the provision of a tear outline comprised of slits or perforations 24 extending through at least the outer ply 18 to the adhesive layer 20.

In order to facilitate the peeling away or tearing off of the coupon 22 or 23 from the container 10 along the tear outline formed by the perforations 24, a suitable release agent or adhesive-repellent medium 26 may be coated prior to lamination of the materials on the rear surface of the coupon portion of the outer ply 18, in effect, the surface which is in contact with the adhesive material 20, to thereby prevent any adhesion between the back of the coupon 22 and the inner ply 16 of the container. Such release agent or adhesive-repellent medium may be constituted of any type, well-known to the art, which will not adhere to the particular adhesive material 20 employed. The area of the surface of the outer ply 18 of the carton which is coated with the release agent 26 is substantially coextensive with the surface area of the coupon 22 confined within the tear outline of the perforations 24.

In the embodiment of FIG. 2 the tear outline defining three sides of the coupon 23 consists of a series of short closely spaced slits 24 which serves to hold the respective coupon edges secure prior to peeling of the coupon. The fourth side of the tear outline includes at least one relatively longer slit 25 of a length sufficient to enable the coupon edge to be engaged and lifted such as by ones fingernail preparatory to peeling thereof.

In the embodiment of FIG. 1 the coupon 22 is defined along one edge by a continuous slit 28 which may at one end thereof include a curved protuberance to serve as a gripping tab 30 for facilitating engagement of the coupon prior to peeling. The continuous slit along one edge avoids the necessity of having to tear along two edges simultaneously at the start of the peeling function and thereby minimizes accidental tearing of the coupon itself.

In the event a wax laminating adhesive is employed, a partial severable bond will result in which case the tear outline may consist of continuous slits along all edges of the coupon, since such partial bond will adequately secure the coupon prior to intentional peeling thereof.

Since the application of the release agent or adhesive-repellent medium 26 is restricted to the area of the rear surface of outer ply 18 which is substantially coextensive with the perforation tear outline 24, as shown in FIG. 3, subsequent to the peeling away of the coupon 22, the outer periphery of that area will have the perforated edges of outer ply 18 closely adhered to the inner wall 16, thereby preventing any inadvertent tearing and disfiguring of the remaining outer ply of the container 10. Moreover, since the perforations 24, 25, 28 do not cut into the inner ply 16 to any appreciable extent, the strength and integrity of the carton 10 remains essentially unimpaired to allow for long-term storage and use by the consumer of the merchandise contained therein.

Figures 4, 5, 6, 7:
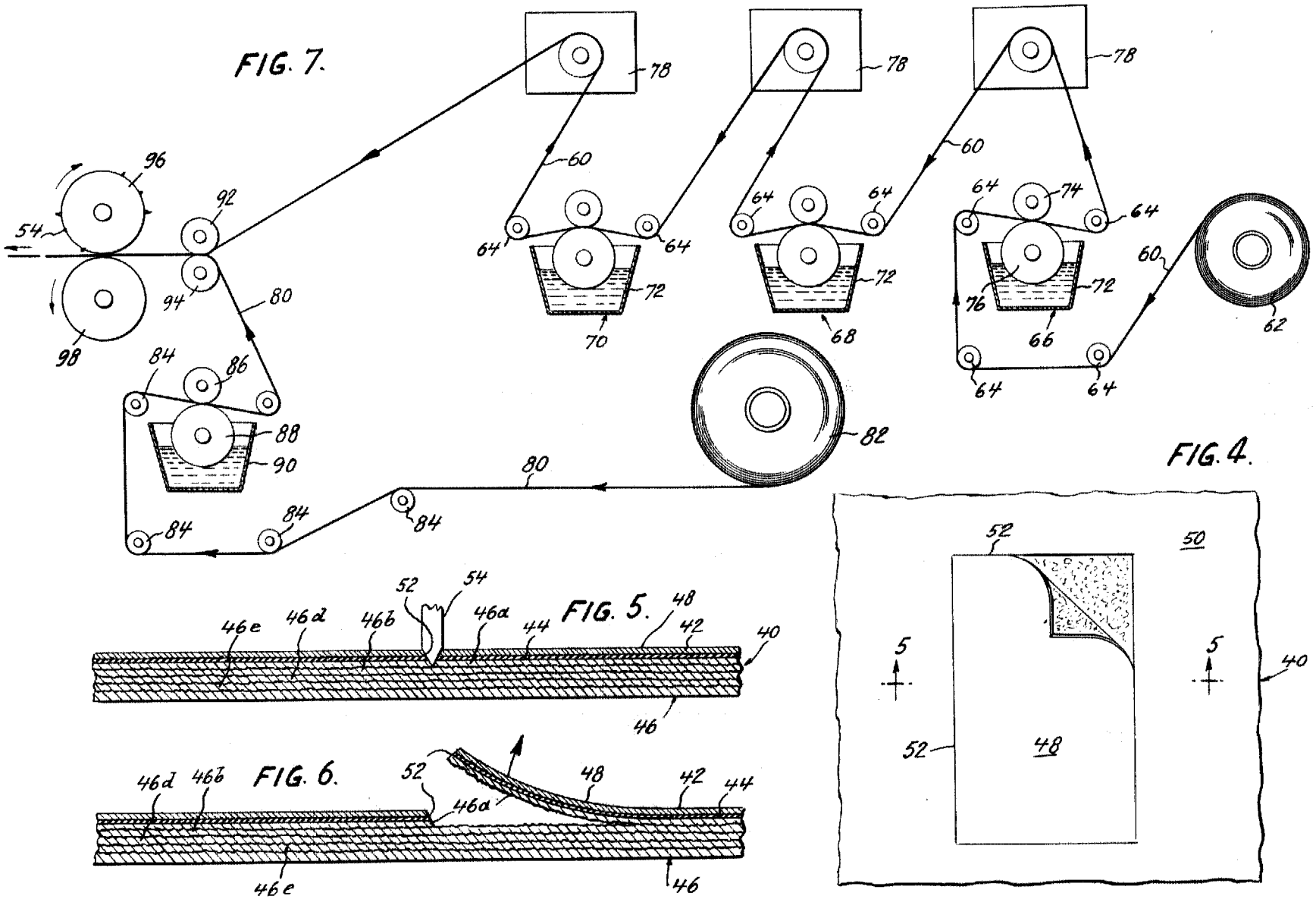
FIG. 4 is a partial elevational view of another embodiment of a laminated container structure pursuant to the present invention.
FIG. 5 is a sectional view, on an enlarged scale, taken along line 5—5 in FIG. 4, and illustrating a cutting tool in its position when forming the perforated tear line.
FIG. 6 is a view similar to that of FIG. 5 showing the coupon formed in the outer ply of the container structure in the process of being detached.
FIG. 7 schematically illustrates an installation for producing laminated carton blanks.

The laminated container structure or package 40 illustrated by the embodiment in FIGS. 4 through 6 of the drawing differs from that of the embodiments shown in FIGS. 1 to 3 in that no release agent or adhesive-repellent medium is interposed between the rear surface of outer paper ply 42 forming the coupon and the adhesive material or glue 44 bonding the outer ply 42 to the inner paperboard ply 46.

In this embodiment, the inner ply 46 is generally constituted of cylinder board, namely, laminated plies or layers of fibers produced in accordance with the cylinder process for making paperboard. This construction provides a plurality of layers 46a, 46b, 46c, 46d, 46e, and so forth, depending upon the desired board thickness of the inner ply 46. These layers or plies adhere intimately to each other but are able to be separated from each other by the mere expedient of being pulled apart.

A detachable or peelable coupon 48 is formed in one of the panel surfaces 50 of the container 40 by providing a tear outline 52 constituted of continuous slits encompassing the coupon area. The slits may be formed by a suitable cutting tool 54, and are cut to extend through the outer ply 42, the adhesive material 44 and the outermost ply or top liner 46a of the cylinderboard 46. Thus, when it is desired to peel the coupon 48 from the container 40, one needs only to insert a fingernail into one of the slits 52 and to pull the coupon 48 away from the container surface in the direction of arrow A, as shown in FIG. 6 of the drawing. This will cause the layers 46a and 46b of the inner ply 46 to separate, without disturbing the integrity of the closed container 40.

It should be noted that the use of printed cylinder board alone, without a paper ply laminated thereto, will produce a similar result. In this case a portion of the top liner of the board itself serves as a coupon which is peelable from the remainder of the board.

FIG. 7 of the drawing illustrates schematically an arrangement or method for making laminated carton blanks erectable into the novel carton structure incorporating a peelable coupon or the like as heretofore described. As shown, a continuous 60 of pliant packaging material intended to serve as the outer ply of the resultant cartons, such as a glossy finish paper, is fed from a supply spool 62 and directed by suitably located rolls 64 to a series of three printing stations 66, 68 and 70 in succession. Each printing station includes a receptacle 72 for containing a printing media in which is immersed a printing or etched cylinder 76 cooperating with an impression roll 74 for applying the print media to the web. Also associated with each print station is a heated chamber or oven for drying the imprint made at the respective print station before the web proceeds to the next station of the series.

The print media applied to the web at the first print station 66 is an ink which may be applied over the entire top surface of the web, the imprint including suitable text or legend for that portion of the web ultimately becomming a peelable coupon on the resultant carton.

In applications where it is desired that printing be carried on the backside of the resultant coupon, this can be accomplished at printing station 68, the printing cylinder of which to apply an ink imprint on the backside of the web only in the area thereof constituting the coupon. At print station 70 the print media is a release agent which, as in the case of the preceding print station, is applied to the backside of the web in the area thereof constituting the coupon.

Although the disclosed example shows provision for one color printing, it should be understood that multicolor printing of the web 60 could be achieved by provision of an appropriate or desired number of additional printing stations according to the numbers of different colors desired. Also, if printing on the backside of the coupon portion of the web is not desired, the printing station 68 would be eliminated. After receiving a coating of the release agent on the backside of the coupon area, the web 60 proceeds to laminating rolls 92, 94 where it is joined to a continuous web 80 of a heavier more rigid packaging material, such as paperboard or the like which is supplied from a spool 82 thereof. The paperboard web 80 as it leaves the spool 82 is directed by guide rollers 84 to a laminant applicator comprised of a laminating cylinder 88 immersed in a laminant contained in receptacle 90 and operating in conjunction with an impression roll 86 to apply the laminant to the entire suface of the web which interfaces with the continuous web 60. The two webs thus become firmly bonded to one another over their entire interfacing surfaces except in the coupon area thereof which as aforementioned has a coating of a release agent applied thereto.

The cutter wheel 96 is provided not only with knives for severing entire carton blanks from the web but also with shorter knives 54 adapted for less board penetration and arranged to produce the tear outline defining the coupon area of the resultant cartons. As heretofore mentioned the tear outline consists of perforations or slits, which may be either continuous or discontinuous, through the outer ply but stopping short of any appreciable penetration of the inner board ply of the laminated material so as to thereby enable peeling off of the coupon without destroying or substantially effecting the integrity of the carton.

Although FIG. 7 shows a cutter of the rotary type, it shoulder be understood that other types of cutters, such as a flat bed type, could be utilized to achieve the same results. Also, for reasons of disclosure simplification, FIG. 7 shows the printing operation occurring simultaneously or in line with the laminating, cutting operation. This, however, is not a necessary aspect of the disclosed method. Since printing presses could generally run at a considerably higher speed than laminators or cutters, in many instances it could be more practical and preferred to preprint the paper web 60 and rewind it for laminating and cutting at a subsequent independent operation. In this manner, one printing installation can be utilized to meet the needs of more than one laminator-cutter installation.

From the foregoing it will become readily apparent that the present invention provides a novel and improved means and method for incorporating redeemable coupons or the like with packaged consumer products. It can be produced at substantially the same cost as the most conventional form printed on carton coupons but has the additional advantage over such conventional coupons of being immediately redeemable at the time of purchase in that it may be easily detached or peeled off from the carton without adversely affecting or destroying the integrity of the carton, or requiring the use of specialized tools or cutting instruments.

While there has been shown and described what are considered to be preferred embodiments of the invention, it should be understood that variations in form and detail could readily be made without departing from the spirit of the invention. It is therefore intended that the invention be not limited to the exact form and detail shown herein and described, nor to anything other than the whole of the invention as hereinafter claimed.

What is claimed is:

1. A carton constituting an erected carton blank formed from laminated packaging material and comprised of an inner relatively rigid ply, an outer relatively pliant ply adapted to have indicia imprinted on at least the outer surface thereof, and adhesive disposed intermediate said plies for laminating same to each other, the outer ply of said blank having a manually removable section at a predetermined interior surface area thereof enclosed by a tear outline comprised of a series of slits penetrating through said outer ply to a depth less than the thickness of said blank said slits being formed in said carton blank subsequent to the lamination of said outer ply to said inner ply and to thereby preclude any adhesive between said plies entering said slits, the opposed edges of said slits being unadhered to one another to facilitate separation of said section from said outer ply, and an adhesive release agent coated on the inner surface of said section to prevent adhesive bonding of said section with said inner ply, said removable section in the erected carton being peelable from said carton along said tear outline leaving said inner ply intact to maintain the structural integrity of said carton.

2. A carton according to claim 1 wherein said tear outline is generally rectangular in configuration with the major portion of at least one side thereof comprising a continuous slit to facilitate the separation of said removable section from said carton.

3. A carton according to claim 2 wherein said tear outline at one end of said continuous slit includes a curved proturberance defining a tab to facilitate gripping of said removable section in preparation for the peeling thereof from said carton.

4. A carton according to claim 1 wherein the inner ply of said laminated packaging material is paperboard and the outer ply is paper.

5. A carbon constituting an erected carton blank composed of laminated packaging material comprising a relatively rigid inner ply adhered to a relatively pliant outer ply adapted to have indicia imprinted on at least the outer surface thereof, said outer ply including a manually removable section defined by a tear outline extending around a predetermined interior surface area thereof, said tear outline comprising a series of slits penetrating said blank from the side of said outer ply to a depth at least equal to the thickness of said outer ply and less than the thickness of said blank, said slits being formed in said carton blank subsequent to the lamination of said outer ply to said inner ply and to thereby preclude any adhesion between said plies along said tear outline defined by said slits the opposed edges of said outer ply at said slits being unadhered to one another to facilitate manual separation of said section from said outer ply, said removable section when said blank is erected into a carton being disposed within one wall panel thereof and manually peelable therefrom along said tear outline leaving said inner ply substantially intact to maintain the structural integrity of said carton.

6. A carton according to claim 5 wherein the laminating adhesive adhering said plies together is a wax substance.

* * * * *